US005144730A

United States Patent [19]

Dilo

[11] Patent Number: 5,144,730

[45] Date of Patent: Sep. 8, 1992

[54] METHOD OF PRODUCING NEEDLED, STRUCTURED AND TEXTILE WEBS

[75] Inventor: Johann P. Dilo, Eberbach, Fed. Rep. of Germany

[73] Assignee: Oskar Dilo Maschinenfabrik KG, Eberback, Fed. Rep. of Germany

[21] Appl. No.: 562,404

[22] Filed: Aug. 2, 1990

Related U.S. Application Data

[63] Continuation-in-part of Ser. No. 521,444, May 10, 1990, abandoned.

[30] Foreign Application Priority Data

Aug. 3, 1989 [DE] Fed. Rep. of Germany ..... 3925757
Jul. 18, 1990 [DE] Fed. Rep. of Germany ..... 4022891

[51] Int. Cl.[5] ..... D04H 5/08
[52] U.S. Cl. ..... 28/109
[58] Field of Search ..... 28/109

[56] References Cited

U.S. PATENT DOCUMENTS

| | | | |
|---|---|---|---|
| 4,144,366 | 3/1979 | Lewis | 28/109 X |
| 4,199,635 | 4/1980 | Parker | 28/109 X |
| 4,205,113 | 5/1980 | Hermansson et al. | 28/109 X |
| 4,211,593 | 7/1980 | Lochner | 28/109 X |
| 4,379,189 | 4/1983 | Platt | 28/109 X |
| 4,555,425 | 11/1985 | Reim et al. | 28/109 X |

FOREIGN PATENT DOCUMENTS

| | | | |
|---|---|---|---|
| 3444763A1 | 6/1986 | Fed. Rep. of Germany . | |
| 149095 | 2/1980 | German Democratic Rep. | 28/109 |
| 7108955 | 3/1968 | Japan | 28/109 |

*Primary Examiner*—Werner H. Schroeder
*Assistant Examiner*—John J. Calvert
*Attorney, Agent, or Firm*—Rosen, Dainow & Jacobs

[57] ABSTRACT

A method of producing needled, structured and patterned velour textile web of nonwoven fleeces and fibrous textile material, wherein at least one layer of textile fibers, particularly staple fibers, creating a pattern is applied to at least a part of an at least single-ply pre-needled support fleece web by at least one of the characteristics selected from the group comprising color, form, material, degree of fineness and orientation, and, finally, subjecting the web to an additional one-step or, if applicable, multi-step needling for the patterning or structuring, with the fibers applied to the support web being pushed through the web until they become visible on the lower side of the web, with the pile of the fibers coming to rest substantially in the plane of the lower surface of the web and wherein the web lies for processing during all steps on a brush belt with a homogeneous surface formed by the tips of the bristles of the brush belt.

35 Claims, 1 Drawing Sheet

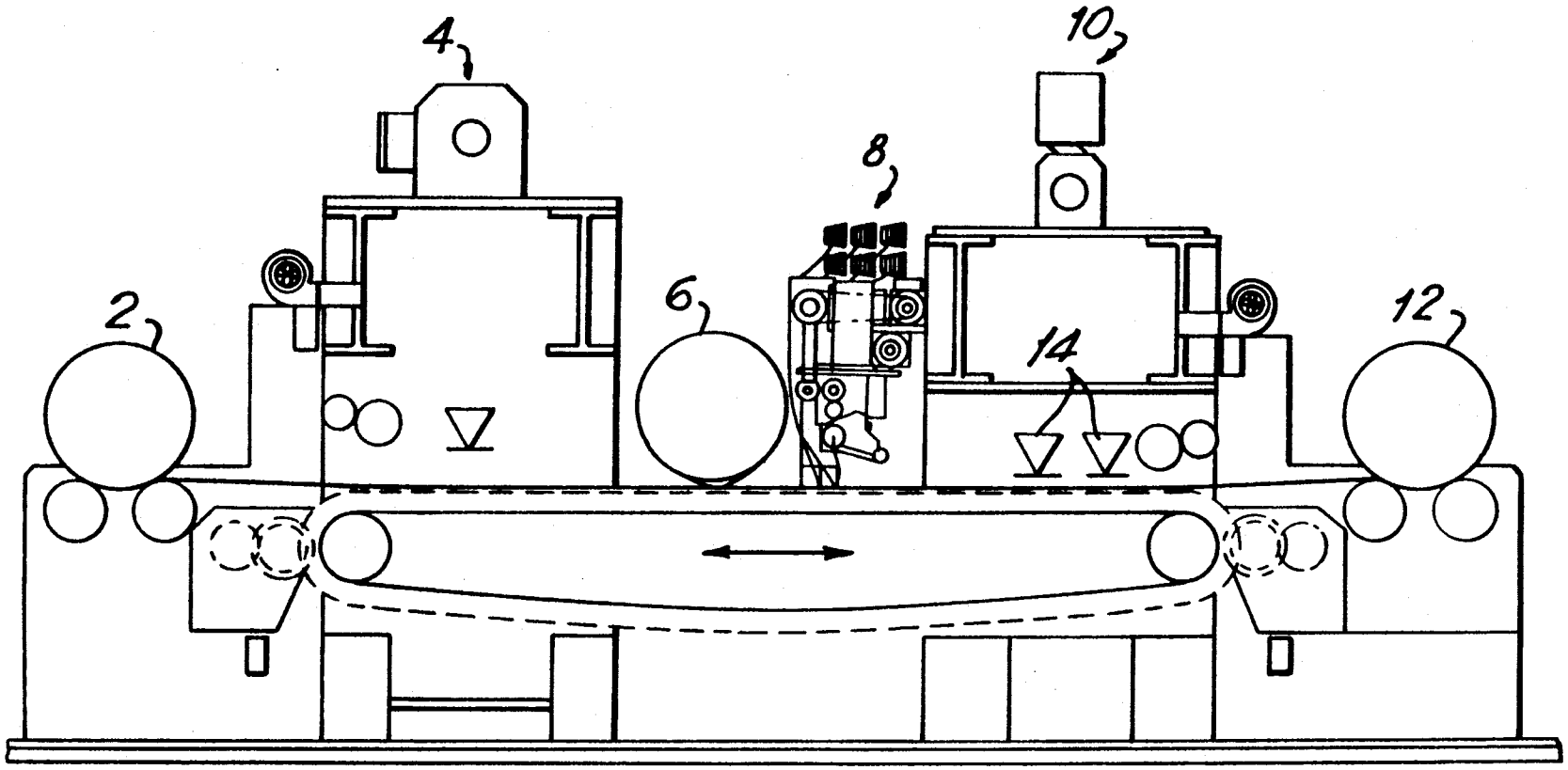
12
10
14
8
6
4
2

METHOD OF PRODUCING NEEDLED, STRUCTURED AND TEXTILE WEBS

This application is a continuation-in-part of application Ser. No. 521,444, filed May 10, 1990, now abandoned.

BACKGROUND OF THE INVENTION

This invention refers to a method of producing needled, structured and patterned textile velour webs of nonwoven fleeces and fibrous textile material.

An installation for the production of structured needle-bonded velour textile webs is known in the German laying-open specification DE-OS 34 44 763, which installation comprises a mechanically or aerodynamically operating fleece laying machine, a pre-needling machine and a velour needling machine, in which at least the velour needling machine is equipped with an endless brush belt supporting the nonwoven fleece to be needled and serving as a needling base. The brush belt is composed of a plurality of brush plates carrying bristle bundles, the outer edges of which brush plates are zigzagged such that the respective edges mesh with adjacent brush plates in such a way that the bristle bundles along the outer edges are spaced apart from one another by the same distance as those in the interior region of the brush late. The free ends of the bristles of the bristle bundles are trimmed to a conical or wedged shape, the holding-down plate rests on the nonwoven fleece web and is pressed down against the same, and crown needles are used for the three-dimensional structuring of the pre-needled nonwoven fleece.

OBJECT OF THE INVENTION

The invention is based on the task of developing a process by means of which it is possible to produce variedly and diversely patterned and/or structured textile velour webs of needle-punched nonwoven fabric simply and with the lowest possible apparative expenditure.

DESCRIPTION OF THE DISCLOSURE

For the solution of this task, in accordance with the invention, a method is proposed in which at least one layer of textile fibers, particularly staple fibers, effecting a pattern is applied to all or part of a single-ply or multi-ply pre-needled nonwoven fleece web, said fibers differing from the fibers of the support web by their color and/or form and/or material and/or degree of fineness and/or orientation. Finally, this web is subjected to an additional one-step or, if applicable, multi-step needling to form a structured and patterned velour web, with the fibers applied to the support web being pushed through said web until they become visible on the lower side of the web, with the pile of said fibers coming to rest substantially in the plane of the lower surface of the web.

Fork needles are preferably used to produce the structured velour webs. However, crown needles can also be used in addition to the fork needles, if the desired structuring of the support web requires this. In most cases it is sufficient to use one single needle aggregate equipped, if applicable, with two parallel needle beams for the structuring.

The support web can be made of a wide variety of starting materials, namely either a pre-needled random laid nonwoven fleece or a pre-needled nonwoven fleece web with fibers oriented substantially is the longitudinal or transverse web direction. The starting material can be single-ply or multi-ply. It is also possible for the individual layers to contain fibers oriented in very specific directions within the web. The production of such starting materials takes place in a manner known per se, with the aid of machines and/or apparatus which are known per se.

The fiber material necessary for the patterned effect of the needle-punched velour webs can be applied by laying an additional fiber material web of nonwoven fleece on all of the support web or in strips on part of said web and then further handling the latter as given above. Instead of wide or strip-like nonwoven fleece webs, a plurality of flat pieces of a non-woven fleece web with the desired geometrical form can be laid onto the support, depending on the desired patterning, which pieces then cover portions of said support web.

If pieces with any geometrical shape are punched out of a nonwoven fleece regularly, repeating the pattern, or irregularly, then either the punched out pieces or the fleece from which they were punched can be applied to the support web.

To obtain the optimum desired patterning of the final product, the fibers in the nonwoven fleeces or similar flat fibrous structures or pieces thereof which have been applied to the support web are oriented transversely to the main orientation of the fibers is the support web. In this way, the fibers effecting the patterning are optimally caught by the fork needles and pushed through the support web to the lower side thereof, which, later on, is the upper side of the finished product.

According to a further variation of the method, the staple fibers effecting the patterning can be applied to all or part of the support web with a continuous or discontinuous or intermitting air current. This is done expediently by permitting the air current charged with fibers to exit from at least one nozzle disposed above the support web; the fibers conveyed by the air current are thereby precipitated on the support web, namely at those places at which the nozzle or nozzles is or are located. If applicable, it can be advantageous for a vacuum to be produced below the support web in the region above which the nozzle or nozzles is or are located, in order to hold the staple fibers, particularly those laid up on the support web in accordance with a predetermined pattern, securely to the support web to prevent them from being laterally blown away by the air current conveying the fibers and escaping to the side.

The nozzles at the end of an aggregate for supplying the staple fibers with the aid of an air current can be embodied in a wide variety of ways. If the staple fibers for the patterning are homogenously distributed on the support web, the nozzle extends across the entire width thereof. If the staple fibers are to be laid up on the support web in strip-like fashion, then for practical purposes several nozzles are arranged in a row above the support web, with the width of the nozzles corresponding to that of the strips of laid up patterning fibers. However, it is also possible to provide one or more stationary or movable nozzles mounted above the support web. If the nozzle(s) is/are movable along an X and/or Y axis within a coordinate system, then the drive mechanisms for the nozzle(s) are actuated according to a predetermined, computer-controlled program, in order for the fibers for the patterning to be thereby laid up at very specific places on the moving support web.

However, it is also possible to cover the fiber layer comprised of individual fibers applied with an air stream and laid on the support web, with a stencil band having a cutouts corresponding to the desired patterning, so that the fibers disposed in the area of the cutouts can be drawn off again by means of a suction device; in this way, the fibers of the fibrous layer which are covered by the stencil band lie on the support web and can be processed in the mentioned manner.

A further variation of the method according to the invention is to lay up fibers on the support web in the form of a yarn or several yarns or rovings or fiber slubbings or the like, but with the fibers thereof being so loosely compounded that for patterning purposes they can be thrust through the support web with needles. The yarns, rovings, fiber slubbings or the like can be infinite-fiber structures or finite pieces of the same, which are laid up on the support web either randomly and irregularly or, if applicable, in accordance with a predetermined pattern.

The yarns or yarn pieces or the like can be wound up on spools mounted in a creel movable over the support web. They are doffed from the spool in accordance with their purpose in order to be laid up and, as mentioned before, are deposited on the support web either randomly or according to a pattern. This can be done with the aid of an air stream or, if applicable, a mechanical discarding or depositing device. It is also possible to provide numerically controlled carrier brackets which are movable over the support web for the given purpose, with the spools of wound up yarn or yarn pieces or the like being mounted on said brackets.

Special or additional structured effects can be attained by using more tightly twisted yarns or yarn pieces, which are pushed through the support web to form loops, instead of or in addition to loose yarns and the like.

Instead of individual yarns, rovings or fiber slubbings or the like, it is also possible to lay up flat structure composed of the same on the support web. For instance, these could be loosely woven, grid-like fabric or loose knits or the like, wherein the yarns etc. are arranged in a straight or curved fashion.

It can be advantageous to cover the fibers applied to the support web, regardless of whatever form or structure they may have, with another nonwoven fleece.

The drawing shows a complete plant for carrying out the method of the invention.

The plant may be operated in different working directions. Assuming the working direction is from left to right, a fibre fleece taken from the left hand roll of felt 2 is at first structured in a first needling station 4 to form a velour. Then, a second fleece taken from a second roll of felt 6 is laid upon the upper side (back side) of the pre-needled web (=velour). This multi-layer web is then needled another time in a second needling station 10 which may comprise one or two needle bars 14. Thereby, the density of piles is considerably increased. The needles supported by the needle bar(s) of the second needling station 10 may be arranged in a special pattern so that a respective pattern of piles results therefrom which is visible under the condition that the fibres of the second roll of a felt 6 differ in their characteristic from the fibers of the first roll of felt 12. The supporting (i.e. base) web is supported in the plant by a brush apron which may be lowered and raised in the second needling station to that a register of the pattern may be produced thereby.

The drawing also shows a yarn tacker 8 arranged between both needling stations 4, 10. Thereby, the fibers forming the pattern may be fed to the base web in the form of a yarn. The tacker 8 adheres only the yarn to the base web whereas the right hand needling station 10 needles fibers from the yarn through the pre-needled base web 12 (velour). In this case, the second roll of felt 6 may eventually be omitted. This can take place either before the single needling step or before a second needling step. In this way, the fibers serving for the patterning are no longer recognizable as such from the back of the finished product.

In order to carry out the method according to the invention, a brush belt is preferably used as a supporting surface for the material web for the purpose of processing the same during all method steps, with said brush belt having a surface as homogenous as possible formed by the tips of the bristles, resulting in the best possible support of the material web. Such a brush belt is known in the German laying-open specifiation DE-OS 34 44 763. It has already superbly proven itself in practice and is therefore also optimally suited for the method in question here, as no gaps or places more sparsely or densely covered with bristles exist in the surface of the brush belt. Depending on the specific requirements to be met by the finished product, the primary product(s) created to form the nonwoven fleece web for the purpose of structuring the same can be stretched in a manner which is known per se, depending on the orientation of the fibers contained in the nonwoven fleece, or in other directions as well. This method is known per se and therefore requires no further explanation.

As already mentioned, for the final needling of the material web to produce the finished product, fork needles are used, in which the planes in which the forks are located are transverse to the direction of those fibers which are to be pushed in the shape of pile loops through the support web by the forks. Depending on the specific requirements to be met by the finished product, if the applicable, crown or differently shaped needles can be used in addition to the fork needles.

For the needling of the material web in the last needling step it is advantageous to attach the needles coming into use here by groups to one or more vertically reciprocating needle beams, with the individual needle beams being movable in unison and syncronously or asynchronously to one another, or also singly and independently of each other. The desired patterning in particular is decisive for the movement of the individual needle beams. In this respect it is essential, in the final needling step, even during operation to alter the distance between the needles and the plane of the nonwoven fleece to be needled or the support surface of the support web, and to do so as a function of the patterning to be created. The adjustment of the needle aggregate and/or the support web or its covering in the manner given above can be made mechanically or electrically, also hydraulically.

In this connection provision can also be made for the needle beam to be equipped with needles not across its entire width, but rather only in places or areas, so that there are virtually no limits to the variety of patterning which can be produced.

In this manner, with regard to the patterning, every conceivable variation is possible.

What is claimed is:

1. A method of producing needled, structured and patterned velour textile web of nonwoven material, comprising applying at least one layer of textile fibers, to a pre-needled nonwoven fleece support web said web having an upper and a lower side, said textile fibers differing from the fibers of said support web by their color, form, material, degree of fineness, orientation or combination thereof, and, finally, subjecting said web to at least one additional needling step wherein the fibers applied to said support web are pushed through said web until they become visible on said lower side of said web and form a substantially upright pile in a plane of the lower side said support web being processed during said method on a brush belt having bristles forming a homogeneous surface comprising the tips of said bristles.

2. A method according to to claim 1, wherein the fibers to be applied to the support web are laid up in the form of a plurality of flat pieces punched out of nonwoven fleece webs, said pieces having the desired the desired geometrical shape and covering portions of said support web.

3. A method according to claim 1, wherein more tightly twisted yarns or yarn pieces are applied to the support web.

4. A method according to claim 1, wherein the fibers or fiber structures lying on said support web are covered with a nonwoven fleece web.

5. A method according to claim 1, wherein the fibers serving for the structuring and/or patterning are applied to said support web prior to a single, first or second needling step.

6. A method according to claim 1, wherein the fibers serving for the structuring and/or patterning are applied to said support web prior to both a first and second needling step.

7. A method according to claim 1, wherein the fiber structures or the fibers applied to the support web are fixed or tacked to said support web by needling or by a vacuum below the support web.

8. A method according to claim 1, wherein prior to its structuring the pre-needled nonwoven fleece web is stretched in a manner known per se, depending on the orientation of the fibers contained in the fleece or in other directions.

9. A method according to claim 1, wherein fork needles are used for the final needling of the webs and wherein said fork needles are oriented such that the planes of said forks are transverse to the direction of the fibers to be pushed in the form of pile loops through the support web by said forks.

10. A method according to claim 1, wherein for the final needling of the web crown needles are also used in addition to fork needles.

11. A method according to claim 1, wherein the needles of the last needling step are attached by groups or areas to one or more vertically reciprocal needle beams.

12. A method according to claim 11, wherein the needles for the final needling of the textile web are arranged on the needle beam or beams of the needle aggregate according to a scheme corresponding to the desired patterning.

13. A method according to claim 1, wherein the final needling step the distance between the needles and the plane of the supporting surface of the support web is mechanically, electrically or hydraulically variable even during operation, in accordance with a control program.

14. A method according to claim 1, wherein the support web is made by pre-needling a random-laid nonwoven fleece.

15. A method according to claim 14, wherein the support web comprises a pre-needled nonwoven fleece web with fibers oriented substantially longitudinally of said web.

16. A method according to claim 14, wherein the support web comprises a pre-needled nonwoven fleece web with fibers oriented substantially transverse to said web.

17. A method according to any one off claims 1, 14, 15, or 16 wherein the fibers to be applied to the support web are laid up in the form of at least one additional nonwoven fleece web covering the entire area of said support web.

18. A method according to claim 17, wherein the fibers in the nonwoven fleeces or pieces thereof applied to the support web are oriented transversely to the orientation of the fibers of the support web.

19. A method according to claim 17, wherein pieces with the desired geometrical shape are punched out of the nonwoven fleece web to be laid onto the support web.

20. A method according to any one of claims 1, 14, 15 or 16 wherein the fibers to be applied to the support web are laid up in the form of strips of one or more nonwoven fleece webs partially covering said support web.

21. A method according to claim 20, wherein the fiber layer applied to the support web is covered with a stencil band having cutouts corresponding to the desired patterning, and the fibers inthe area of the cutouts are suctioned off again.

22. A method according to any one of claims 1, 14, 15 or 16, wherein the stable fibers to be applied to the support web are applied to part or all of the area of said support web with the aid of a continuous or discontinuous or intermitting air stream.

23. A method according to claim 22, wherein the air stream charged with fibers exits from at least one nozzle or the like extending across the entire width or only a portion or several portions of the width of the support web.

24. A method according to claim 23 wherein the nozzle or nozzles is/are movable in any desired direction relative to the support web.

25. A method according to claim 22, wherein the air stream charged with fibers exists from one or more nozzles.

26. A method according to any one of claims 1, 14, 15, or 16 wherein the fibers to be applied to the support web are laid up onto said support web in the form of a yarn or several yarns or rovings or fiber slubbings.

27. A method according to claim 26, wherein the yarns, rovings or fiber slubbings are infinite or finite pieces.

28. A method according to claim 26, wherein the yarns or the like and/or yarn pieces are laid up according to a predetermined pattern or are randomly laid up.

29. A method according to claim 28, wherein the yarns or the like and/or year pieces are doffed from spools mounted in a creel movable, if applicable, over said support web, and are laid up on said support web.

30. A method according to claim 28, wherein the yarns or the like and/or yarn pieces are doffed from spools mounted on numerically controlled carrier brackets movable over said support web.

31. A method according to claim 26, wherein the yarns, rovings or fiber slubbings are intertwined to form a flat structure.

32. A method according to claim 26, wherein the yarn pieces are applied to said support web by means of an air nozzle or mechanical discarding device.

33. A method for producing a needled, structured and patterned velour textile web of at least partially nonwoven fleece, comprising:

needling a fiber-containing nonwoven fleece web from a first side thereof, whereby fibers comprising said web are forced through said web to the second side thereof opposite said first side;

assembling textile fibers on said first side of said web, said textile fibers having a characteristic that is visually distinguishable from the fibers or said nonwoven fleece web; and needling the assembled textile fibers and fleece web through said textile fibers toward said first side of said fleece web to push a predetermined pattern of said textile fibers through said nonwoven fleece a sufficient distance to be visible at said second side of said nonwoven fleece web said textile fibers form a substantially upright pile in a plane of said second side.

34. The method of claim 33 wherein said step of assembling textile fibers on said nonwoven fleece web comprises assembling said textile fibers on said nonwoven fleece web in said predetermined pattern, whereby the pattern of said textile fiber on the first side of said nonwoven fleece web is visible on said second side of said nonwoven fleece web.

35. The method of claim 33 wherein said step of assembling textile fibers on said nonwoven fleece web comprises assembling a nonpatterned web of said textile fibers on said nonwoven fleece web, and said step of needling the assembled textile fibers and fleece web comprises needling only a part of said assembled textile fibers and fleece web in accordance with said predetermined pattern, whereby fibers of said nonpatterned web in accordance with said predetermined pattern are pushed through said nonwoven fleece web.

* * * * *